US009675115B2

(12) United States Patent
Liu

(10) Patent No.: US 9,675,115 B2
(45) Date of Patent: Jun. 13, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 676 days.

(21) Appl. No.: 14/096,874

(22) Filed: Dec. 4, 2013

(65) Prior Publication Data

US 2014/0373858 A1 Dec. 25, 2014

(30) Foreign Application Priority Data

Jun. 19, 2013 (CN) ..... 2013 2 0353462 U

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/06
See application file for complete search history.

(56) References Cited

U.S. PATENT DOCUMENTS

| | | | | |
|---|---|---|---|---|
| 4,480,650 | A * | 11/1984 | Weinert | A24D 1/02 131/349 |
| 6,106,845 | A * | 8/2000 | Wong | A47G 21/183 424/400 |
| 6,606,998 | B1 * | 8/2003 | Gold | A24F 47/002 128/202.21 |
| 2006/0130857 | A1 * | 6/2006 | Roth | A24F 47/002 131/273 |
| 2012/0138054 | A1 * | 6/2012 | Hearn | A24F 47/002 128/203.12 |

* cited by examiner

*Primary Examiner* — Cynthia Szewczyk
(74) *Attorney, Agent, or Firm* — Tim Tingkang Xia, Esq.; Locke Lord LLP

(57) ABSTRACT

The disclosure discloses an electronic cigarette. The electronic cigarette comprises a cigarette rod provided with an air outlet for cigarette smoke flowing out, wherein the electronic cigarette further comprises a break means formed on an edge area around the air outlet to be convenient for users to smoke after removing the break means. In this disclosure, a break means configures around an air outlet for the cigarette smoke flowing out. In such case, firstly, removing the break mean while users use the electronic cigarette, which can be regarded as a mark for judging whether the electronic cigarette has been used or not. With such construction, it is convenient for users to judge whether the electronic cigarette has been used or not, which is more healthy and can avoid diseases transmitting crossly between users.

15 Claims, 3 Drawing Sheets

ELECTRONIC CIGARETTE

CROSS-REFERENCE TO RELATED APPLICATIONS

This non-provisional application claims priority under 35 U.S.C. §119(a) on Patent Application No. 201320353462.2, filed in P.R. China on Jun. 19, 2013, the entire contents of which are hereby incorporated by reference.

FIELD OF THE INVENTION

The present invention relates to the technical field of electronic-heating technology, and more particularly relates to an electronic cigarette.

BACKGROUND OF THE UTILITY MODEL

At present, an electronic cigarette includes a suction mouth for smoking. The suction mouth for smoking may be an independent part mounted at one end of an atomizer or the electronic cigarette. When users use the electronic cigarette, they need to smoke with the suction mouth for smoking by turning on a switch or an induction signal from an airflow sensor. Sometimes user may put the smoked electronic cigarette into a cigarette box for the next smoking.

It is difficult to judge whether an electronic cigarette has been used or not, because there is no marks for judging whether the electronic cigarette has been used or not. When many users use electronic cigarette received in the same cigarette box, they would not find which one is right for them, which will cause a health problem. Moreover, even if the cigarette box is a special one, it also is difficult to judge whether the electronic cigarettes received in the cigarette box is used or not.

SUMMARY OF THE INVENTION

Aiming at the drawbacks in the prior art that it is difficult to judge whether the electronic cigarette has been used or not, an electronic cigarette that can judge whether it is used or not is provided in the disclosure.

The electronic cigarette provided in the disclosure comprises a cigarette rod provided with an air outlet for cigarette smoke flowing out, wherein, the electronic cigarette further comprises a break means formed on an edge area around the air outlet to be convenient for users to smoke after removing the break means In one embodiment, the cigarette rod includes an outer tube and a suction mouth cover, wherein the suction mouth cover configuring the air outlet covers one end of the outer tube. The suction mouth cover and the break means are formed integrally as one piece. The outer tube, the suction mouth and the break means are formed integrally as one piece.

In the embodiment, the break means comprises a holding part and a connecting part, wherein the connecting part is connected to the edge area and the holding part is formed on one end of the connecting part, the end is far away from the edge area.

In the embodiment, the connecting part and the edge area are connected with each other in a connecting line structure. The connecting line structure is a creases line structure. The creases line structure is configured around the edge area around the air outlet. The creases line structure comprises a plurality of line segments, which are spaced from each other.

In the embodiment, the holding part and the connecting part are formed integrally as one piece.

In another embodiment, the break means comprises a holding part, a connecting part and a plurality of connecting ribs connected to the edge area, the holding part is connected to one end of the connecting ribs through the connecting part, and the end is far away from the edge area.

In a further embodiment, the break means comprises a holding part and a plurality of connecting ribs connected to the edge area, the holding part is connected to one end of the connecting ribs, and the end is far away from the edge area. The connecting ribs are provided around the edge area, which are spaced from each other. A thickness of each connecting rib ranges from 0.15 mm to 0.5 mm. A shape of each connecting rib is any one of square, circle, oval and triangle. A thickness of a junction between the connecting part and the edge area of the connecting part is less than that of the other parts of the connecting part. A shape of the holding part is any one of globe, spherical, swallow tail, disc and pearl strings.

When implanting the invention, the following advantages can achieve:

In this disclosure, a break means is provided around an air outlet for cigarette smoke flowing out. In such case, firstly removing the break means, then users can use the electronic cigarette, which can be regarded as a mark for judging whether the electronic cigarette has been used or not. With such construction, it is convenient for users to judge whether the electronic cigarette has been used or not, which is more healthy and can avoid diseases transmitting crossly between users.

BRIEF DESCRIPTION OF THE DRAWINGS

The present disclosure can be further illustrated by reading the example with references made to the accompanying drawings, in which.

DETAILED DESCRIPTION OF THE PREFERRED EMBODIMENT

In this disclosure, a break means is around an air outlet for cigarette smoke flowing out. In such case, firstly removing the break means, then users can use the electronic cigarette, which can be regarded as a mark for judging whether the electronic cigarette has been used or not. With such construction, it is convenient for users to judge whether the electronic cigarette has been used or not, which is more healthy and can avoid diseases transmitting crossly between users.

Figure 1:
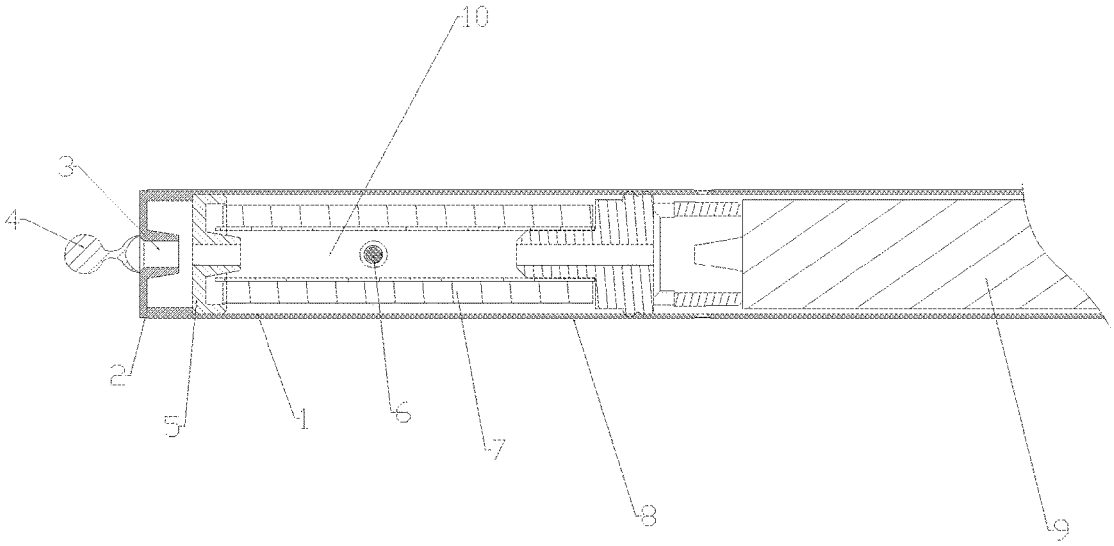
FIG. 1 is a structural view of an electronic cigarette in accordance with an preferred embodiment of the disclosure.

As shown in FIG. 1, A preferred embodiment of the disclosure provides an electronic cigarette. The electronic cigarette comprises a cigarette rod configuring an air outlet for cigarette smoke flowing. A break means is formed on an edge area around the air outlet to be convenient for users to smoke after removing the break means. Specifically, in the embodiment, as shown in FIG. 1, the electronic cigarette comprises an outer tube 1, a suction mouth cover 2, an air outlet 3 and a break means 4. The outer tube 1 may be a bushing for containing atomizer or atomizer and battery. In the embodiment, the outer tube 1 is a bushing for containing atomizer and battery. The outer tube 1 contains a heating wire assembly 6, the cotton for storing smoke tar 7, a sealed ring 5 and a battery 9, they are connected to each other in the same connection way as that of the existing electronic cigarette. The outer surface of the outer tube 1 is pasted a paster 8 that can simulate appearance of a real cigarette. An air passage 10 is formed in the inner of the outer tube 1 for the cigarette smoke flowing. The suction mouth cover 2 covers one end of the outer tube 1 and defines the air outlet 3 communicating with the air passage 10 so that the cigarette smoke can flow out. Of course, in other embodiments, there may be no suction mouth cover 2 covering the outer tube 1. In such case, the outer tube 1 and the suction mouth cover 2 are formed integrally as one piece, and the air outlet 3 is defined on the sidewall of the outer tube 1.

The break means 4 is formed on the edge area around the air outlet 3 and covers whole air outlet 3. Also a part of the air outlet 3 may be covered by the break means 4, or the break means 4 is formed on the side of the air outlet 3. The object for providing the break means 4 herein is that removing the break means 4 can be regarded as a mark to indicate that the electronic cigarette has been used. Thus, the break means 4 only need to be formed on the area around the air outlet 3. The break means 4 should be removed when users use the electronic cigarette. The break means 4 and the outer tuber 1 or the suction mouth cover 2 is formed integrally as one piece. Of course, the break means 4 can be attached to the outer tuber 1 or/and the suction mouth cover 2 by gluing, soldering, or the like.

Figure 2:
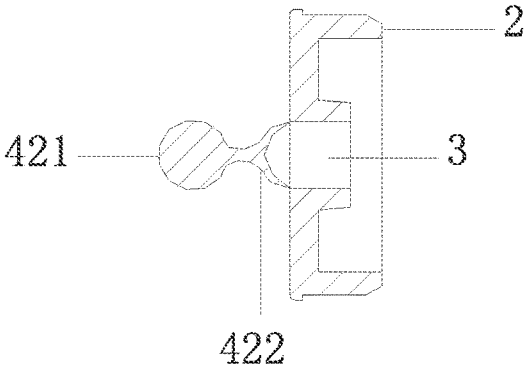
FIG. 2 is structural view of a break means in FIG. 1 accordance with a first embodiment of the disclosure.
Figure 3:
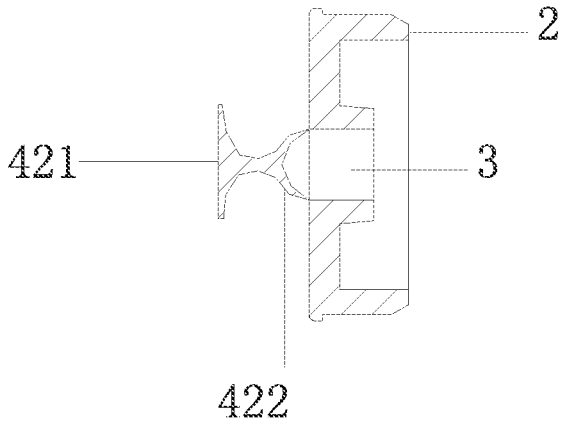
FIG. 3 is structural view of a break means in FIG. 1 accordance with a second embodiment of the disclosure.
Figure 4:
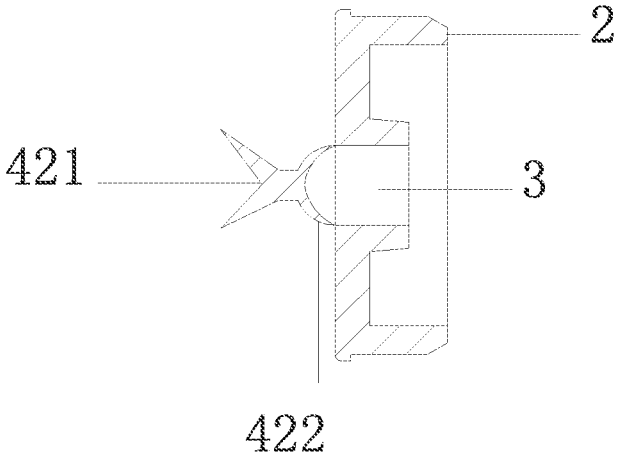
FIG. 4 is structural view of a break means in FIG. 1 accordance with a third embodiment of the disclosure.

Referring to FIG. 2 to FIG. 4, Several embodiments of the disclosure provide the break means 4 in FIG. 1. As shown in the figures, the break means 4 comprises a holding part 421 and a connecting part 422. The connecting part 422 is attached to the edge area around the air outlet 3 by gluing, soldering, or the like. The holding part 421 is connected to one end of the connecting part 422, the end is far away from the edge area. The holding part 421 may have the connecting part 422 integrally formed therewith. Of course, the holding part 421 may be soldered, riveted or affixed to the connecting part 422. In the other embodiment, a transition part may be formed between the connecting part 422 and the holding part 421 to provide users with a good feel.

The connecting part 422 and the edge area are connected with each other in line connection and form a connecting line structure. The connecting line structure is a creases line structure. The creases line structure may be configured around the edge area around the air outlet 3. The creases line structure may be a plurality of line segments, or the creases line structure may be two line segments, which are symmetrical to each other. Wherein, the line segments are spaced from each other. In such construction, the break means 4 can be removed without applied a big force. In other embodiments, a plurality of connecting points can be formed on the junction between the connecting part 422 and the edge area so that it is convenient for removing the break means 4.

The thickness of the junction between the connecting part 422 and the edge area of the connecting part 422 is less than that of the other parts of the connecting part 422 (expect the junction), which is convenient for removing the break means 4.

In the first embodiment, the holding part 421 is globe-shaped. In the second embodiment, the holding part 421 is disc-shaped. In the third embodiment, the holding part 421 is nip-shaped. The holding part also may be spherical-shaped, swallow-tail-shaped, or pearl strings-shaped. In such case, it is convenient for users to hold the break means and removing it, which can provide a good feel for users.

Figure 5:
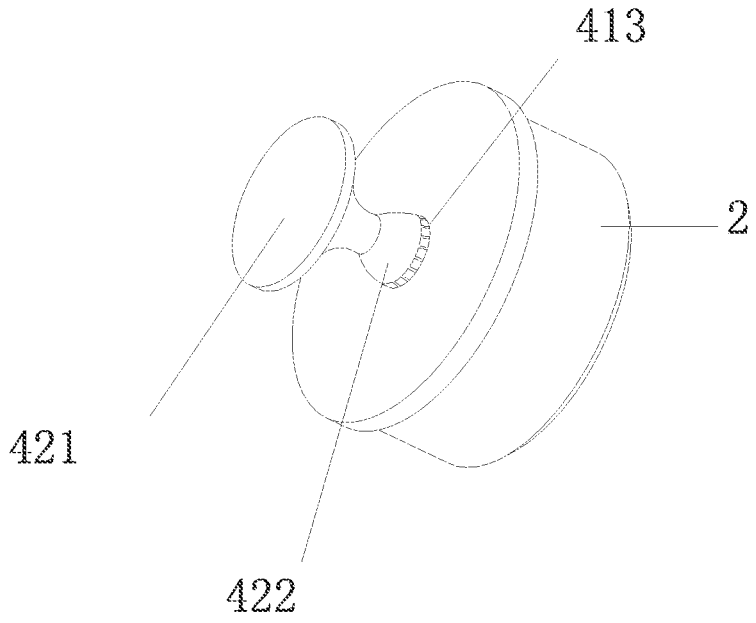
FIG. 5 is structural view of a break means in FIG. 1 accordance with a fourth embodiment of the disclosure.
Figure 6:
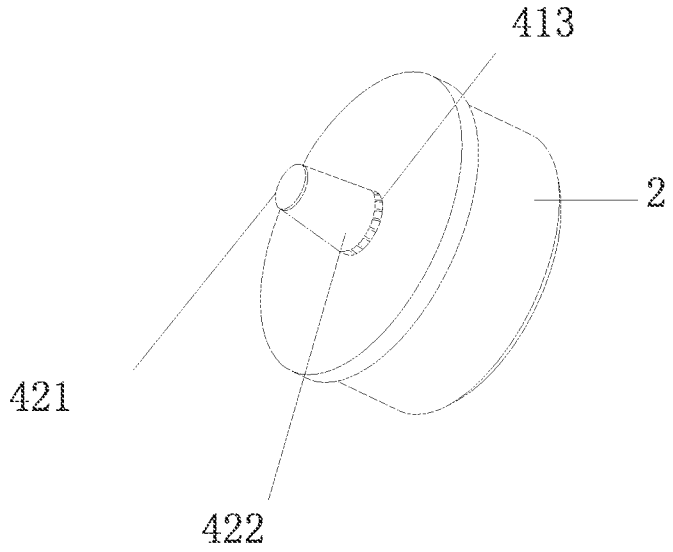
FIG. 6 is structural view of a break means in FIG. 1 accordance with a fifth embodiment of the disclosure.

Referring to FIG. 5 and FIG. 6, Fourth and fifth embodiments of the disclosure provide the break means 4 in FIG. 1. As shown in the figures, the break means 4 in these figures are different from the aforementioned break means 4 in structure. The break means 4 comprises a holding part 421, a connecting part 422 and a plurality of connecting ribs 413. The connecting ribs 413 are form on the edge area of the air outlet 3. The connecting part 422 is connected to one end of the connecting ribs; the end is far away from the edge area. The holding part 421 is connected to the connecting ribs 413 through the connecting part 422. The holding part 421 may have the connecting part 422 and the connecting ribs 413 integrally formed therewith. In another embodiment, the holding part may directly connect to the connecting ribs without providing with the connecting part.

The holding part 421 may be globe-shaped, disc-shaped, cylindrical-shaped, nip-shaped, pearl strings-shaped, or the like. The connecting part 422 is cylindrical-shaped. It also may be hollow cylindrical or solid cylindrical. The cylindrical may be has the same cross sectional area from one end to another end, or the cross sectional area is gradually greater or smaller from one end that is far away from the connecting ribs 413 to the connecting ribs 413.

The connecting ribs configured around the edge area are spaced from each other. The widths between each two connecting ribs may be the same with each other, the widths between each two connecting ribs may be different from each other. The thickness of each connecting rib 413 ranges from 0.15 mm to 0.5 mm to be convenient for broking off the break means 4. Each connecting rib 413 is of square-shape, circle-shape, oval-shape, triangle-shape, or the like. Of course, in other embodiments, the connecting rib 413 may be designed to any other shape which can be connected between the connecting part and the edge area.

While the present invention has been described by reference to preferred embodiments, it will be understood by those skilled in the art that various changes may be made and equivalents may be substituted without departing from the scope of the present invention. However, all the changes will be included within the scope of the appended claims.

What is claimed is:

1. An electronic cigarette; comprising a cigarette rod provided with an air outlet for cigarette smoke flowing out, wherein the electronic cigarette further comprises a break means formed on an edge area around the air outlet to be convenient for users to smoke while the break means has been removed;

wherein the break means comprises a holding part and a connecting part, the connecting part is connected to the edge area and the holding part is formed on one end of the connecting part, the end is away from the edge area;

wherein the connecting part and the edge area are connected with each other in line connection and are formed a connecting line structure; and wherein the connecting line structure is a creases line structure; the creases line structure comprises a plurality of line segments, which are spaced from each other.

2. The electronic cigarette of claim 1, wherein the cigarette rod includes an outer tube and a suction mouth cover, the suction mouth cover covers one end of the outer tube and configures the air outlet.

3. The electronic cigarette of claim 2, wherein the suction mouth cover and the break means are formed integrally as one piece.

4. The electronic cigarette of claim 3, wherein the suction mouth cover, the outer tube and the break means are formed integrally as one piece.

5. The electronic cigarette of claim 1, wherein the holding part and the connecting part are formed integrally as one piece.

6. The electronic cigarette of claim 1, wherein a thickness of a junction, between the connecting part and the edge area, of the connecting part is less than that of the other parts of the connecting part.

7. The electronic cigarette of claim 1, wherein a shape of the holding part is any one of globe, spherical, swallow-tail, disc and pearl strings.

8. An electronic cigarette comprising a cigarette rod provided with an air outlet for cigarette smoke flowing out, wherein the electronic cigarette further comprises a break means formed on an edge area around the air outlet to be convenient for users to smoke while the break means has been removed;

wherein the break means comprises a holding part, a connecting part and a plurality of connecting ribs, wherein the connecting ribs are connect to the edge area, and the holding part is connected to one end of the connecting ribs, the end is far away from the edge area, through the connecting part.

9. The electronic cigarette of claim 8, wherein the connecting ribs are provided around the edge area, which are spaced from each other.

10. The electronic cigarette of claim 9, wherein a thickness of each connecting rib ranges from 0.15 mm to 0.5 mm.

11. The electronic cigarette of claim 10, wherein a shape of each connecting rib is any one of square, circle, oval and triangle.

12. An electronic cigarette comprising a cigarette rod provided with an air outlet for cigarette smoke flowing out, wherein the electronic cigarette further comprises a break means formed on an edge area around the air outlet to be convenient for users to smoke while the break means has been removed;

wherein the break means comprises a holding part and a plurality of connecting ribs, wherein the connecting ribs are connected to the edge area, and the holding part is connected to one end of the connecting ribs, the end is far away from the edge area.

13. The electronic cigarette of claim 12, wherein the connecting ribs are provided around the edge area, which are spaced from each other.

14. The electronic cigarette of claim 13, wherein a thickness of each connecting rib ranges from 0.15 mm to 0.5 mm.

15. The electronic cigarette of claim 14, wherein a shape of each connecting rib is any one of square, circle, oval and triangle.

* * * * *